US006350042B1

(12) United States Patent
Lai

(10) Patent No.: US 6,350,042 B1
(45) Date of Patent: Feb. 26, 2002

(54) PROJECTING LAMP

(76) Inventor: Wei Cheng Lai, 9-47 Ho Hsing, Ho Hsing Village, Hu-Kou, Hsinchu Hsien (TW)

( * ) Notice: Subject to any disclaimer, the term of this patent is extended or adjusted under 35 U.S.C. 154(b) by 0 days.

(21) Appl. No.: 09/736,404

(22) Filed: Dec. 15, 2000

(51) Int. Cl.[7] ..... F21V 21/29

(52) U.S. Cl. ..... 362/277; 362/293; 362/319; 353/62

(58) Field of Search ..... 362/293, 153, 362/269, 277, 280, 284, 319, 287; 353/62

(56) References Cited

U.S. PATENT DOCUMENTS 57,602 A * 8/1866 Warden ..... 362/269
2,341,223 A * 2/1944 Lillie ..... 353/62
4,779,176 A * 10/1988 Bornhorst ..... 353/62

* cited by examiner

*Primary Examiner*—Sandra O'Shea
*Assistant Examiner*—Hargobind S. Sawhney
(74) *Attorney, Agent, or Firm*—Rabin & Berdo, P.C.

(57) ABSTRACT

A projecting lamp for projecting images to create visual and decorative effect is provided. The projecting lamp mainly includes a lamp cylinder mounted on a supporting structure. A projecting structure is mounted in a front opening of the lamp cylinder and includes a focus control bar. By rotating a threaded body of the focus control bar, a distance between a projecting lens located at a front of the projecting structure and a projecting picture located at a rear of the projecting structure is finely adjusted to enable projection of a magnified and clear image. The lamp cylinder is adjustable in its elevation angle and its angular position in a plane. The whole projecting lamp may be quickly disassembled for easy storage and conveyance.

7 Claims, 10 Drawing Sheets

PROJECTING LAMP

FIELD OF THE INVENTION

The present invention relates to a projecting lamp for projecting images to create visual and decorative effect, and more particularly to a projecting lamp having a focus control bar adapted to finely adjust focus of the projecting lamp to project clear image.

BACKGROUND OF THE INVENTION

There are various types of projecting lamps available in the markets, some of which have simple structure while others have complicate structure. These projecting lamps may be used in very wide applications, such as making reports, creating visual and decorative effects, etc.

FIGS. 10A and 10B show a conventional projecting lamp currently available in the market. The projecting lamp includes a hollow cylinder 81 fixedly mounted to a top of a stand 80. An illuminating means capable of emitting intensive light is mounted in a closed rear end of the cylinder 81, and a picture holder 83 holding a projecting picture 82, a locating ring member 84, and a front ring member 86 holding a projecting lens 85 are sequentially mounted in an open front of the cylinder 81 from inner side to outer side. And, two straight rods 8 are rearward extended through the front and the locating ring members 86, 84 to connect their rear ends to the picture holder 83. To use the projecting lamp, the illuminating means is turned on for the same to emit light. The emitted light passes through the projecting picture 82 and the projecting lens 85, so that an image on the projecting picture 82 is projected and magnified on a plane, such as a wall surface.

Since a distance between the projecting lamp and the wall surface varies, it is necessary to adjust a distance between the projecting picture 82 and the projecting lens 85 to project a clear image on the wall surface. In FIG. 10A, the distance between the projecting picture 82 and the lens 85 is large. By pulling the straight rods 8 outward, the distance is shortened, as shown in FIG. 10B. To effect focus control in the conventional projecting lamp, an operator must hold the two straight rods 8 at the same to pull or push them in order to obtain a desired focus. Since there is only a very small adjustable distance between the projecting picture 82 and the lens 85, it is difficult for the operator to apply a suitable magnitude of force on the two straight rods 8 in one direction to obtain the desired focus. It is very possible one movement of the rods 8 would bring the projecting picture 82 to be too close to or too far away from the lens 85. Moreover, only one minor touch or vibration of the projecting lamp would possibly result in undesirable change in the adjusted focus, causing inconvenience in using the projecting lamp.

Further, the above-described focusing structure of the conventional projecting lamp assembled from the projecting picture 82, the lens 85 and the straight rods 8 is fixed in the cylinder 81 through a frictional contact of an inner wall surface of the cylinder 81 with a plurality of leaf springs 841 extended from the lens holder 83 and the locating ring member 84. The leaf springs 841 tend to scrap against and therefore damage the inner wall of the cylinder 81. Moreover, the leaf springs 841 are subject to elastic fatigue after they have been used for a prolonged time and therefore lose their intended function of holding the focusing structure in the cylinder 81.

In the conventional projecting lamp, the cylinder 81 is mounted on a top of a vertical stand 80. It is difficult to adjust the cylinder 81 to different elevation angles and it is impossible to rotate the cylinder 81 in a plane relative to the stand 80 to a desired direction.

Therefore, it is desirable to develop an improved projecting lamp to eliminate the drawbacks existing in the conventional projecting lamps.

SUMMARY OF THE INVENTION

A primary object of the present invention is to provide a projecting lamp that includes a projecting structure and a focus control bar that work together to enable easy and fine adjustment of a distance between a projecting picture and a projecting lens of the projecting lamp, and the adjusted focus of the projecting lamp is not subjected to easy change due to vibration or collision.

Another object of the present invention is to provide a projecting lamp having a lamp cylinder that is adjustable in its elevation-angle and angular position.

A further object of the present invention is to provide a projecting lamp that can be quickly disassembled for easy storage or conveyance.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1B:
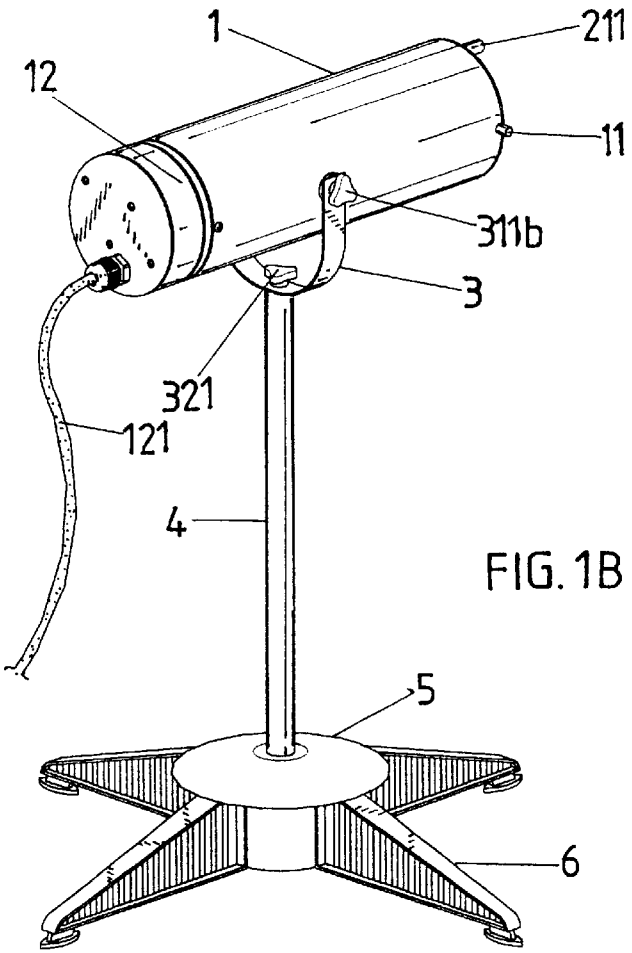
FIGS. 1A and 1B are front and rear perspective views, respectively, of a projecting lamp according to the present invention.
Figure 1A:
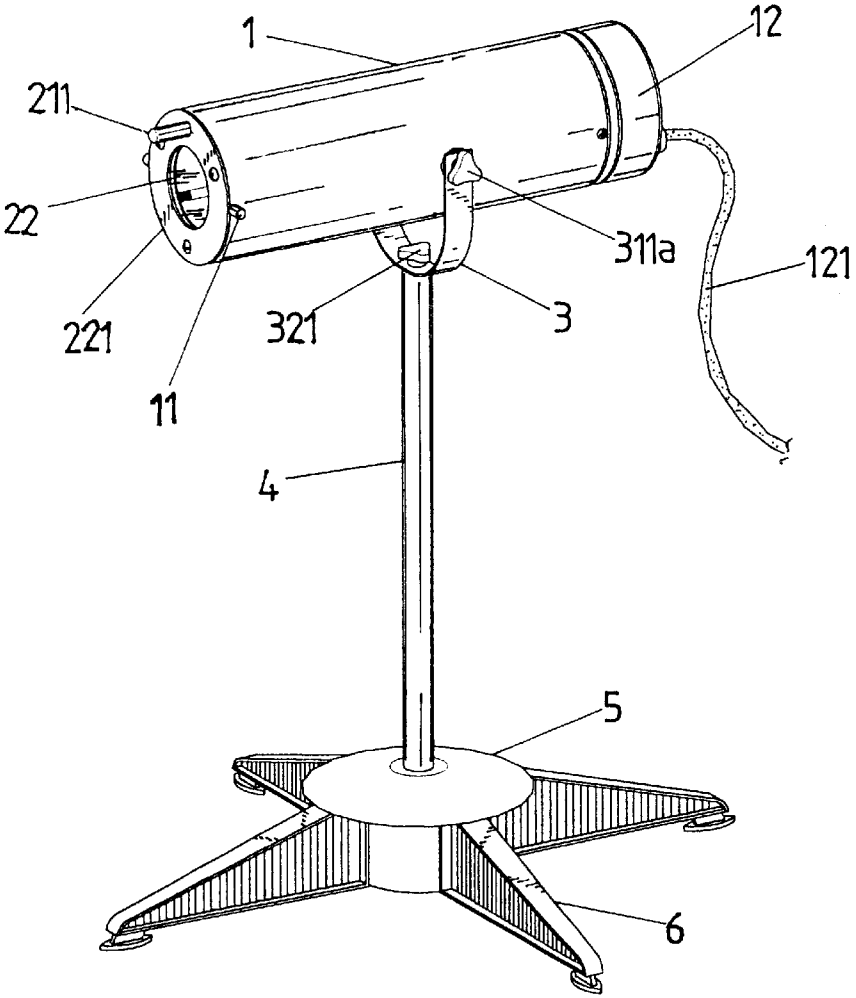
Figure 2:
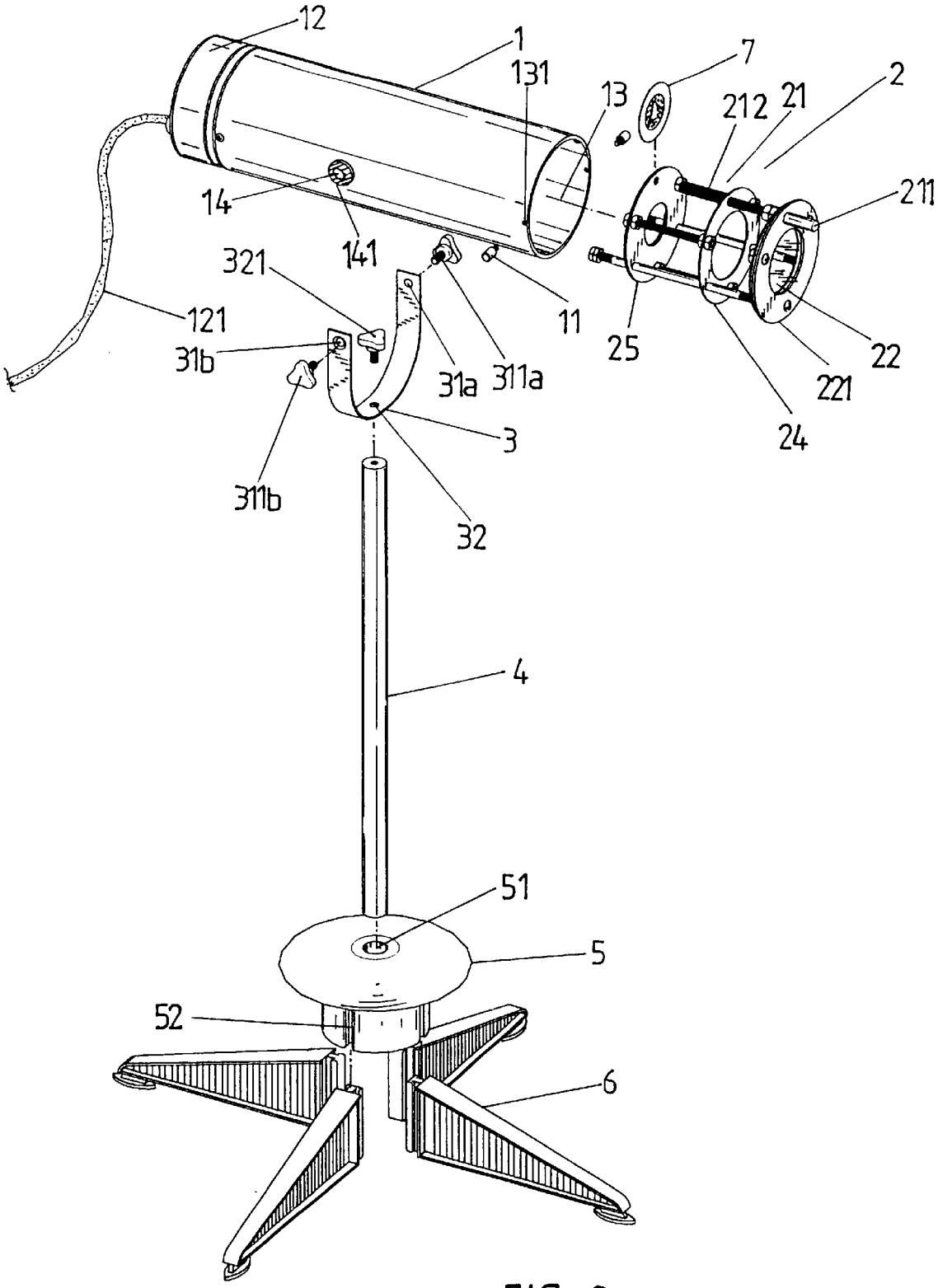
FIG. 2 is an exploded perspective of the projecting lamp of FIG. 1.

Please refer to FIGS. 1A, 1B and 2 that are front, rear, and exploded perspective views, respectively, of a projecting lamp according to the present invention for producing images that are visually attractive and function as decorations. As shown, the projecting lamp mainly includes a lamp cylinder 1, a transformer 12, a projecting structure 2, a connecting means 3, a supporting post 4, a base 5, and a predetermined number of feet 6.

The lamp cylinder 1 is a hollow cylindrical member having a front opening 13. Two diametrically opposite first threaded holes 131 are provided on the lamp cylinder 1 adjacent to the front opening 13 for two screws 11 to thread thereinto. An illuminating means (not shown) is mounted in the lamp cylinder 1 to an inner rear end thereof to serve as a light source. Two diametrically opposite second threaded holes 14 are provided on the cylinder lamp 1 at a middle point thereof. Washers 141 are fitted around the second threaded holes 14.

The transformer 12 is connected to an outer rear end of the lamp cylinder 1 to electrically connect to the illuminating-means in the lamp cylinder 1. An electric cord 121 is connected at one end to the transformer 12 and at another end to a wall-mount socket (not shown) to supply stable power to the illuminating means.

Figure 3A:
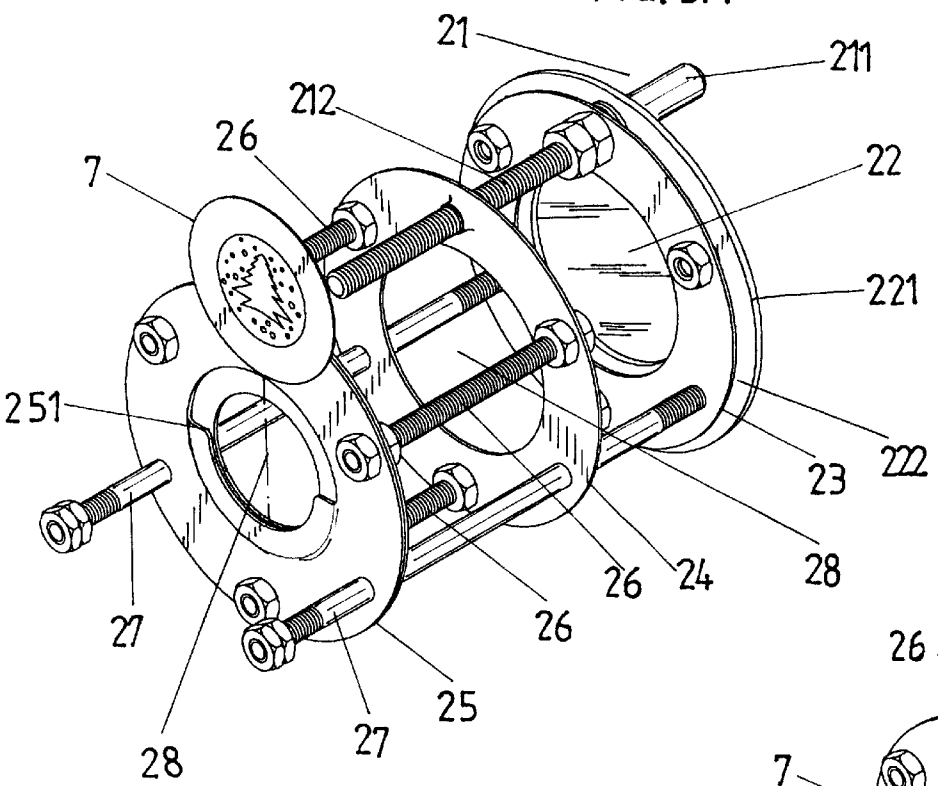
FIGS. 3A and 3B are perspective views showing the projecting structure of the projecting lamp of the present invention and the positioning of a projecting picture into the projecting structure.
Figure 3B:
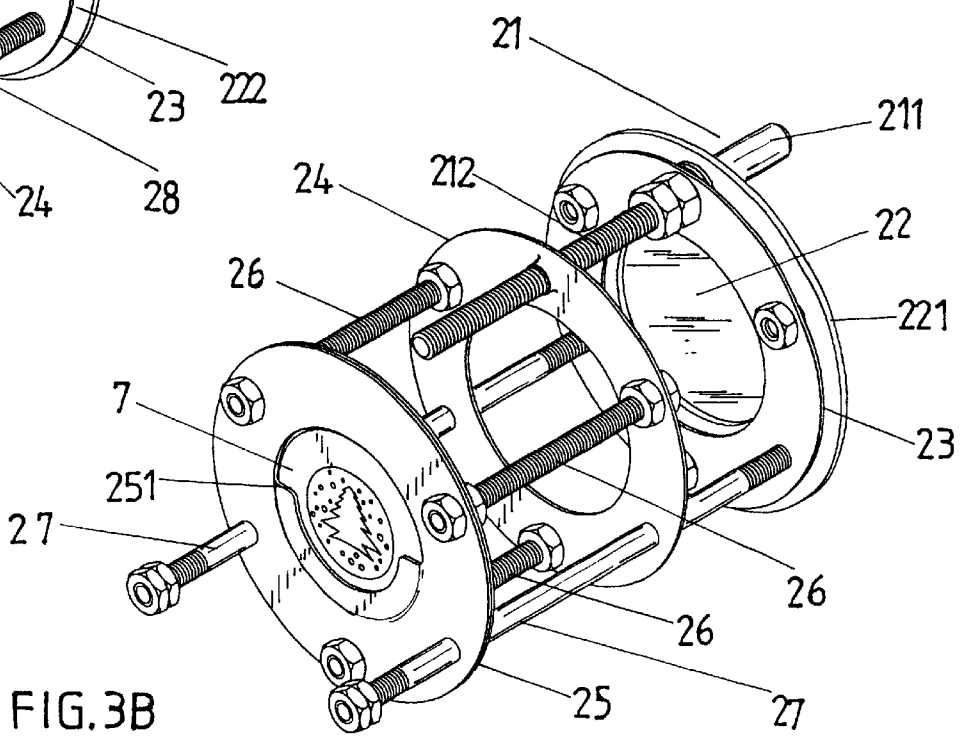

Please refer to FIGS. 2, 3A and 3B. The projecting structure 2 is mounted in the front opening 13 of the lamp cylinder 1 and mainly includes a focus control bar 21, a projecting lens 22, a lens holder 221, a front ring member 23 behind the lens holder 221, a middle ring member 24, and a rear ring member 25.

The lens holder 221, the front ring member 23 and the middle ring member 24 respectively define a first round hole 28 via which light emitted by the illuminating means pass to project an image. The rear ring member 25 defines a second round hole 28 having a size the same as that of a projecting picture 7. The second round hole 28 is provided along a lower half with a semicircular channel 251 into or from which the projecting picture 7 can be quickly inserted or removed.

The projecting lens 22 is fixedly sandwiched between the lens holder 221 and the front ring member 23 by bolts and nuts, so that the projecting lens 22 is aligned with the first round holes 28 and a clearance 222 exists between the lens holder 221 and the front ring member 23.

The middle ring member 24 and the rear ring member 25 are separately fixedly connected to two ends of three parallel fixing threaded rods 26 to form a unit, so that the middle and the rear ring members 24, 25 always stably move together in the lamp cylinder 1 in the same direction. Two spaced guide bars 27 have one externally threaded end screwed into the clearance 222 between the lens holder 221 and the front ring member 23 and another end extended through the middle ring member 24 and the rear ring member 25 to project from the rear ring member 25, such that the unit of the middle and the rear ring members 24, 25 is allowed to smoothly slide on and along the guide bars 27.

The focus control bar 21 includes a handle portion 211 forward extended through the front ring member 23 and the lens holder 221 to project from the lens holder 221 for an operator to conveniently hold thereat, and an externally threaded body portion 212 rearward extended from the handle portion 211 to thread through a threaded hole on the middle ring member 24. Thus, when the focus control bar 21 is rotated at the handle portion 211, the handle portion 211 is freely rotatable without moving the lens holder 221 and the front ring member 23 while the threaded body portion 212 would bring the middle ring member 24 to axially move along the focus control bar 21. Since the rear ring member 25 is distantly connected to the middle ring member 24 through the three fixing rods 26, the unit of the middle and the rear ring members 24, 25 axially moves on and along the focus control bar 21 and the guide bars 27. This arrangement allows fine adjustment of a distance between the projecting picture 7 inserted in the semicircular channel 251 on the rear ring member 25 and the projecting lens 22 by rotating the focus control bar 21 at the handle portion 211 and thereby obtain a desired focus for the projecting lamp.

Figures 4A, 4B:
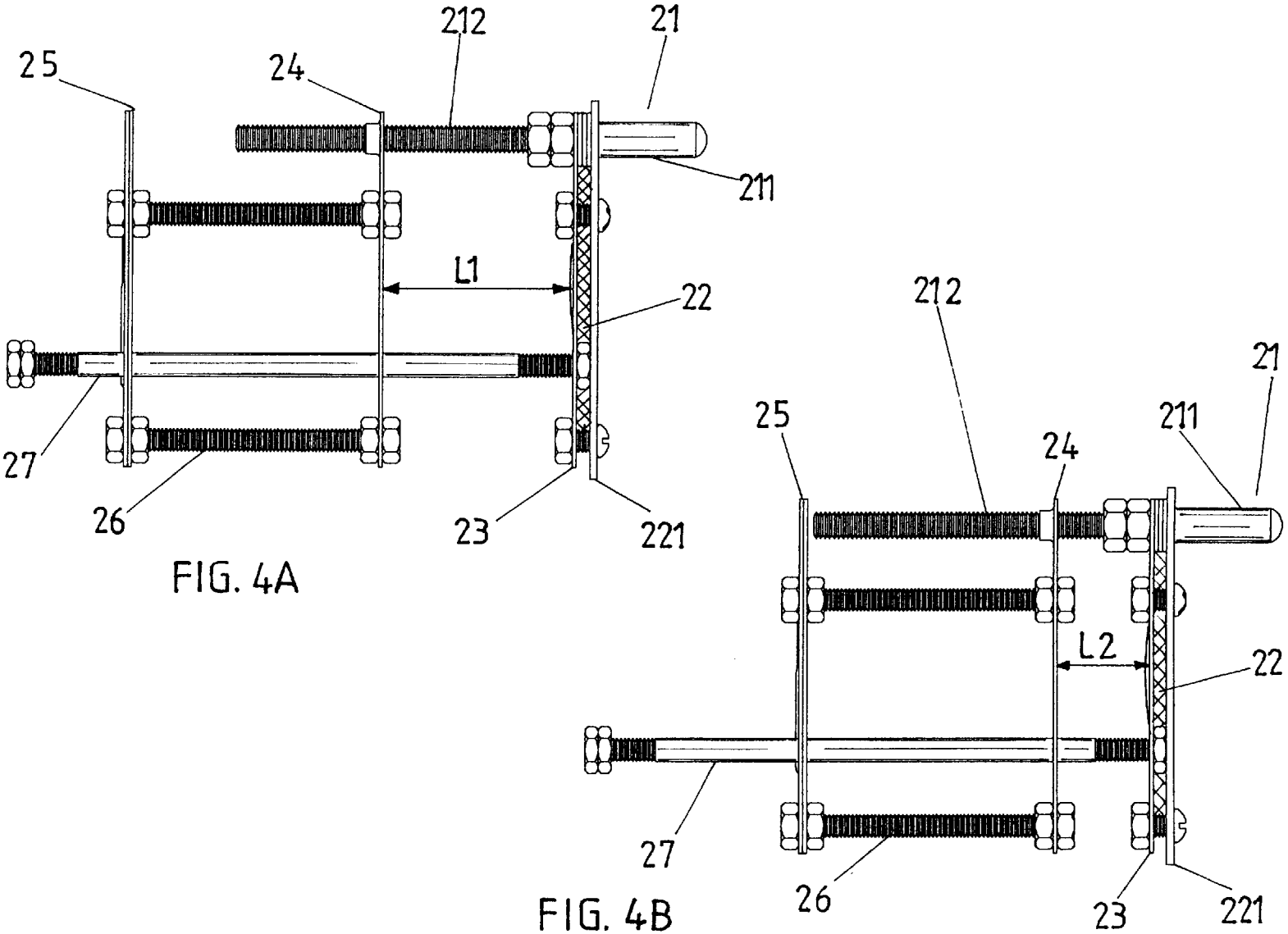
FIGS. 4A and 4B are side views showing the adjustment of the focus control bar of the projecting lamp of the present invention.

FIGS. 4A and 4B are side views showing the focus control of the projecting lamp via the focus control bar 21. In FIG. 4A, an initial distance between the front ring member 23 and the middle ring member 24 is L1. When an operator grips at the handle portion 211 to turn the focus control bar 21 and cause the middle ring member 24 to axially move along the threaded body portion 212 of the focus control bar 21 toward the front ring member 23, the distance L1 between the middle and the front ring members 24, 23 is shortened to a difference distance L2, as shown in FIG. 4B. That is, the rear ring member 25 having the projecting picture 7 attached thereto could be axially finely moved along with the middle ring member 24 through turning the focus control bar 21 to achieve the focus control.

Figure 5B:
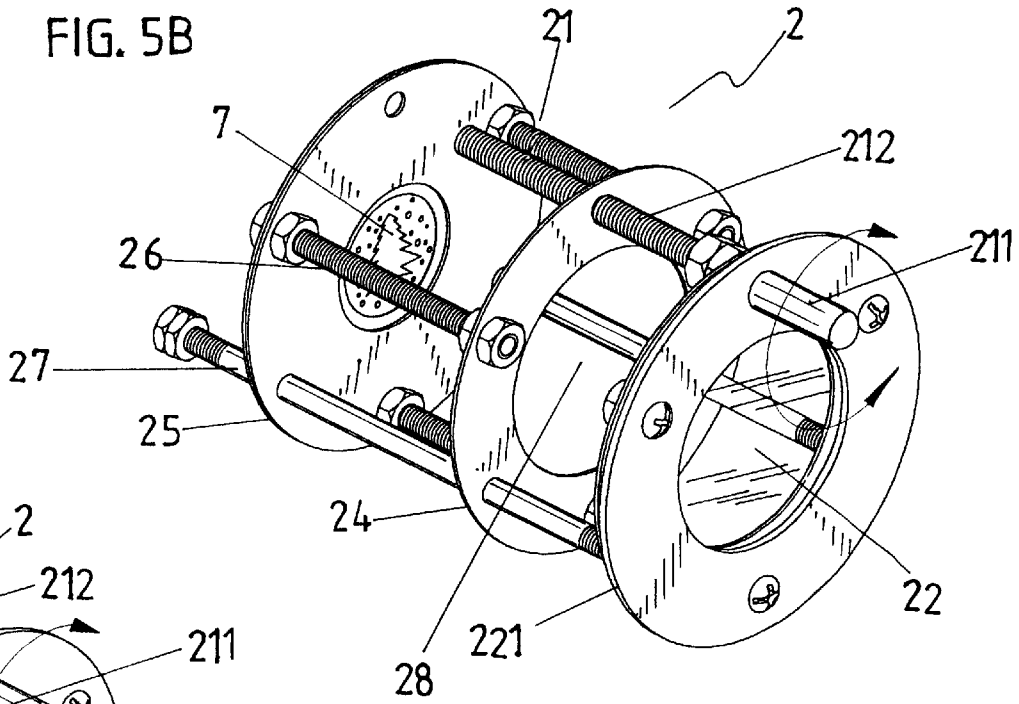
FIGS. 5A and 5B are perspective views showing the operation of the focus control bar of the projecting lamp of the present invention.
Figure 5A:
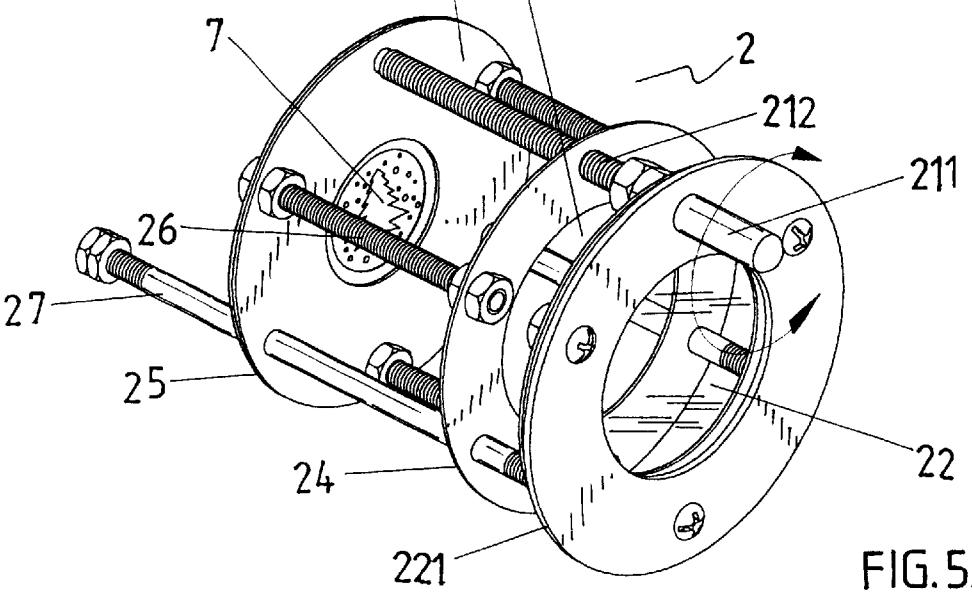

FIGS. 5A and 5B are perspective views showing the operation of the projecting structure 2 of the projecting lamp of the present invention. When the focus control bar 21 is rotated, the middle and the rear ring members 24, 25 connected together by the fixing rods 26 are brought to axially move at the same time, enabling adjustment of distance between the lens 22 and the projecting picture 7 on the semicircular channel 251 on the rear ring member 25.

Figures 6A, 6B:
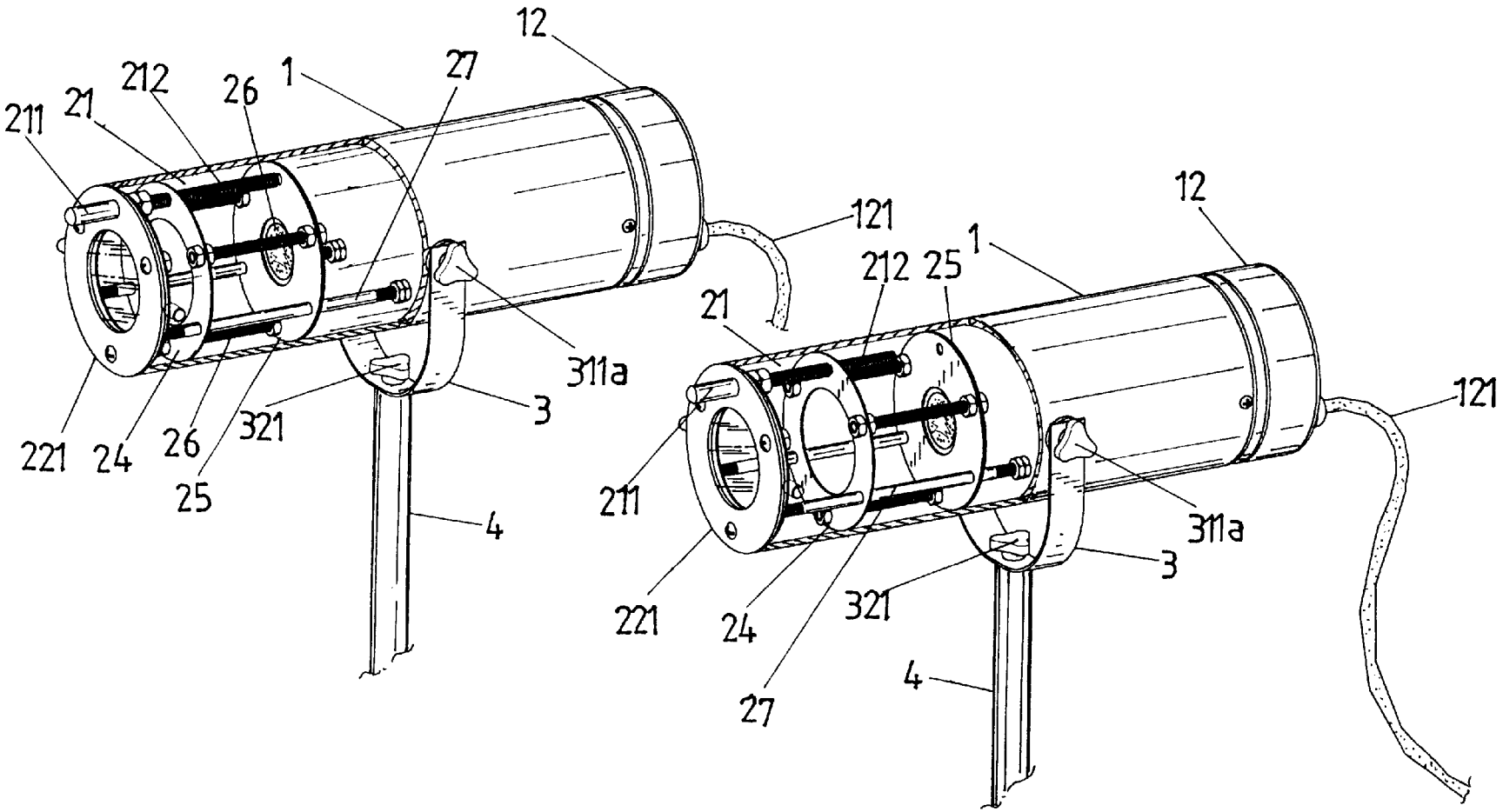
FIGS. 6A and 6B are perspective views of the lamp cylinder of the present invention with the projecting structure mounted therein.

FIGS. 6A and 6B are perspective views of the lamp cylinder 1 with the projecting structure 2 mounted therein, showing the focus control bar 21 is rotated to adjust the distance between the lens 22 and the projecting picture 7.

Figure 7:
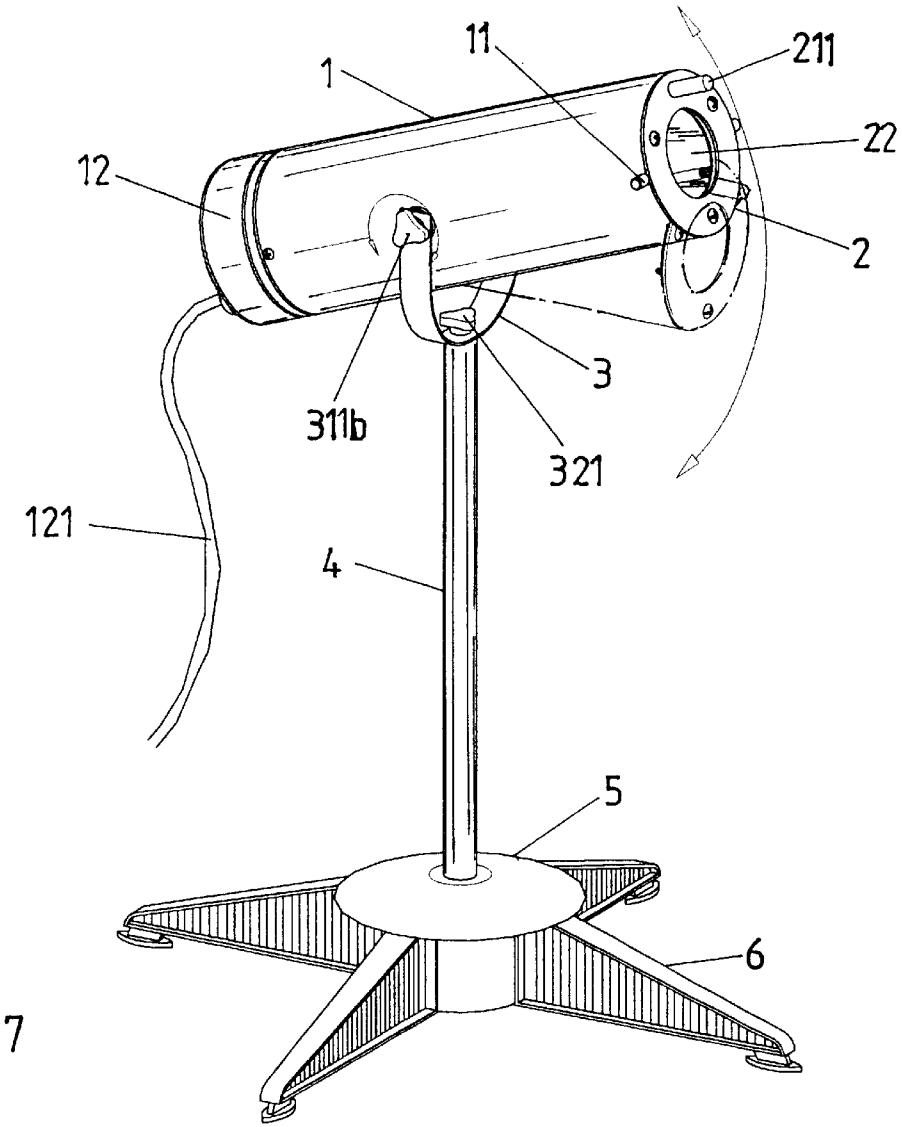
FIG. 7 is a perspective showing the adjustment of the lamp cylinder of the present invention to a desired elevation angle.
Figure 8A:
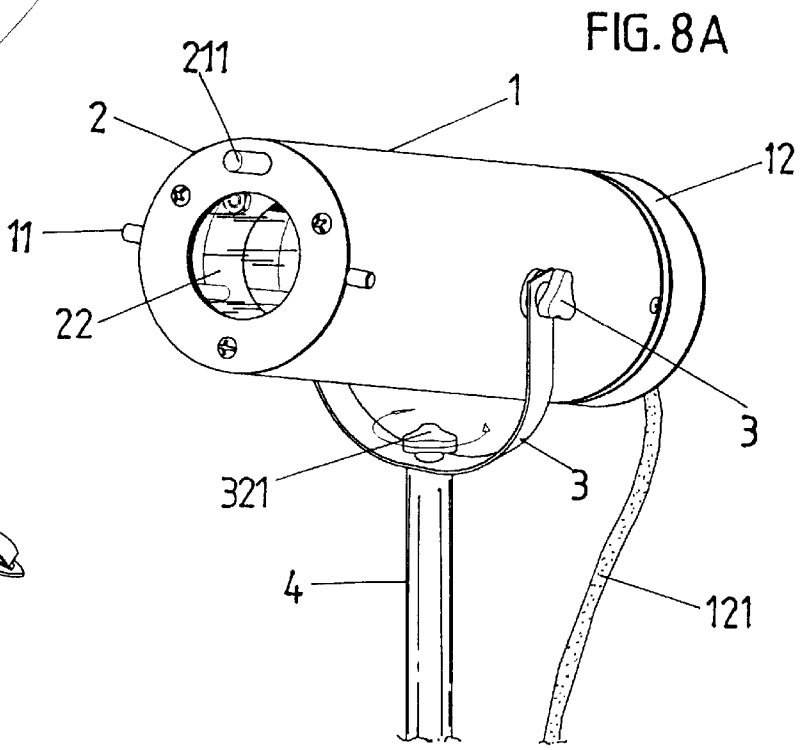
FIGS. 8A and 8B are perspective views showing the rotation of the lamp cylinder of the present invention within a plane.
Figure 8B:
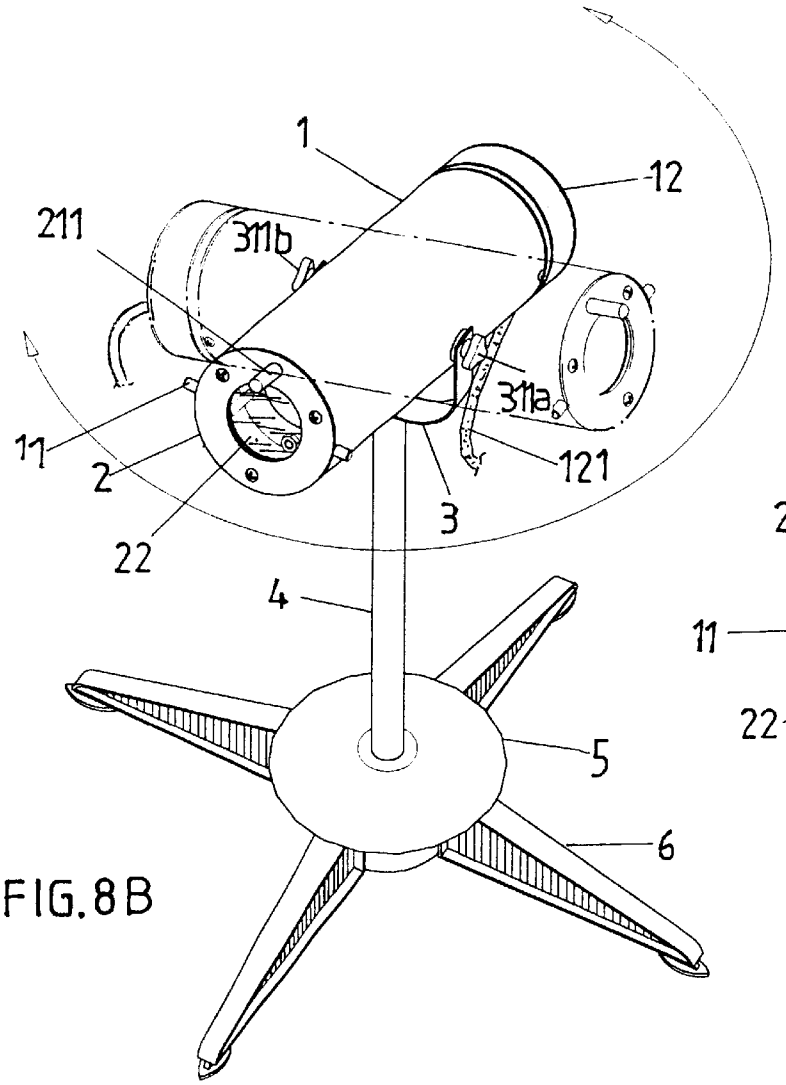

Please refer back to FIG. 2. The connecting means 3 is a U-shaped member being provided at two ends and a center with threaded holes 31*a*, 31*b*, and 32, respectively. The lamp cylinder 1 is adapted to suspend in the U-shaped connecting means 3 by tightening two first adjusting screws 311*a* and 311*b* through the two threaded holes 31*a*, 31*b* at two ends of the U-shaped connecting means 3 into the two second threaded holes 14 on the lamp cylinder 1. Please refer to FIGS. 2 and 7 at the same time. By properly loosening the two first adjusting screws 311*a*, 311*b*, the lamp cylinder 1 can be pivotally turned relative to the connecting means 3 to a desired elevation angle. Please refer to FIGS. 8A and 8B. A second adjusting screw 321 is downward threaded through the threaded hole 32 at the center of the U-shaped connecting means 3 into a top of the supporting post 4. When the second adjusting screw 321 is properly loosened, the lamp cylinder 1 could be rotated in a plane by 360 degrees relative to the supporting post 4, as indicated by the dotted lines in FIG. 8B.

Please refer back to FIG. 2 again. The base 5 is provided at a top with a fixing hole 51 for firmly receiving a lower end of the supporting post 4 therein. A lower portion of the base 5 is provided with a predetermined number of guide grooves 52 into which feet 6 are detachably connected for the projecting lamp of the present invention to stand stably.

Figure 9:
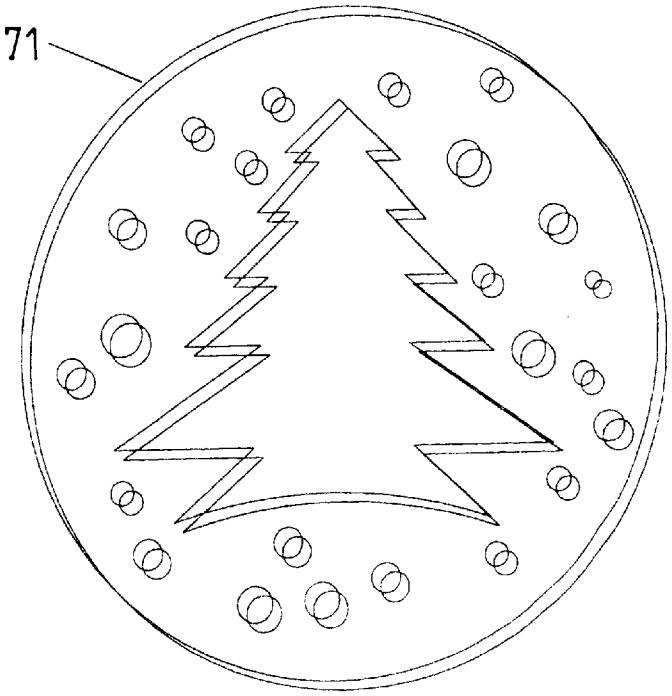
FIG. 9 shows the focus control of the present invention to project a clear image.
Figure 9:
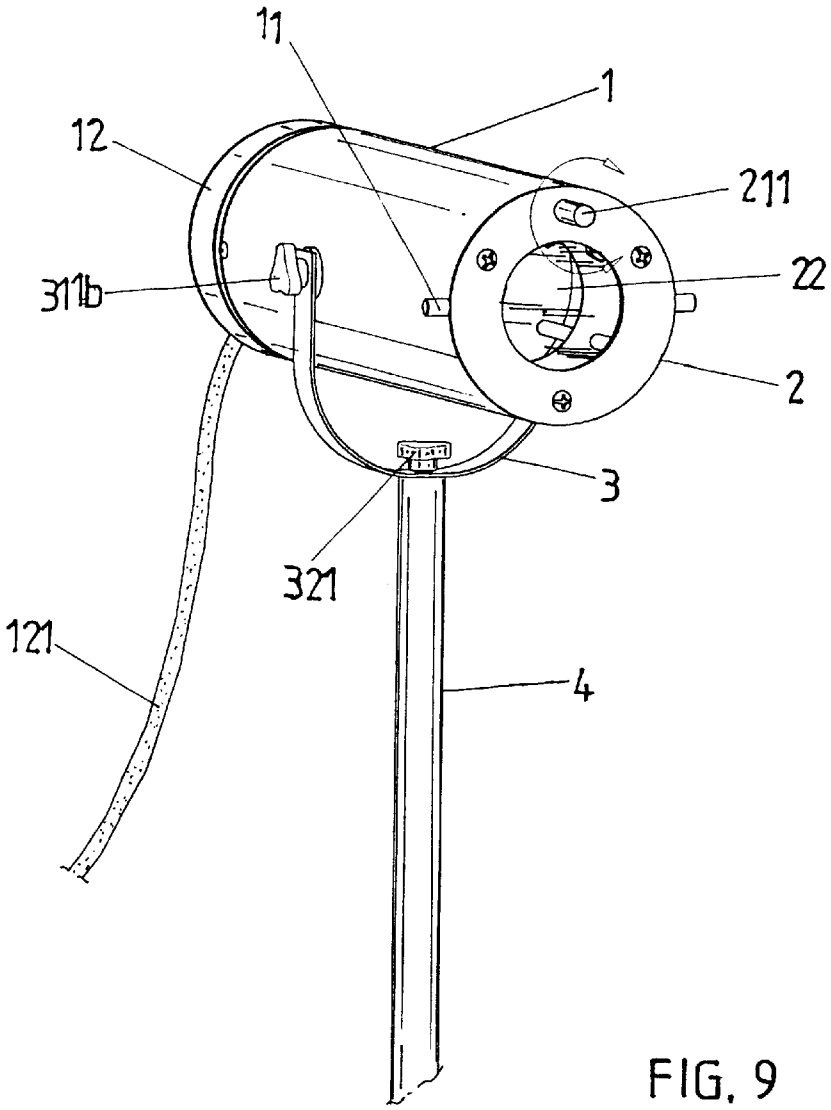
Figures 10A, 10B:
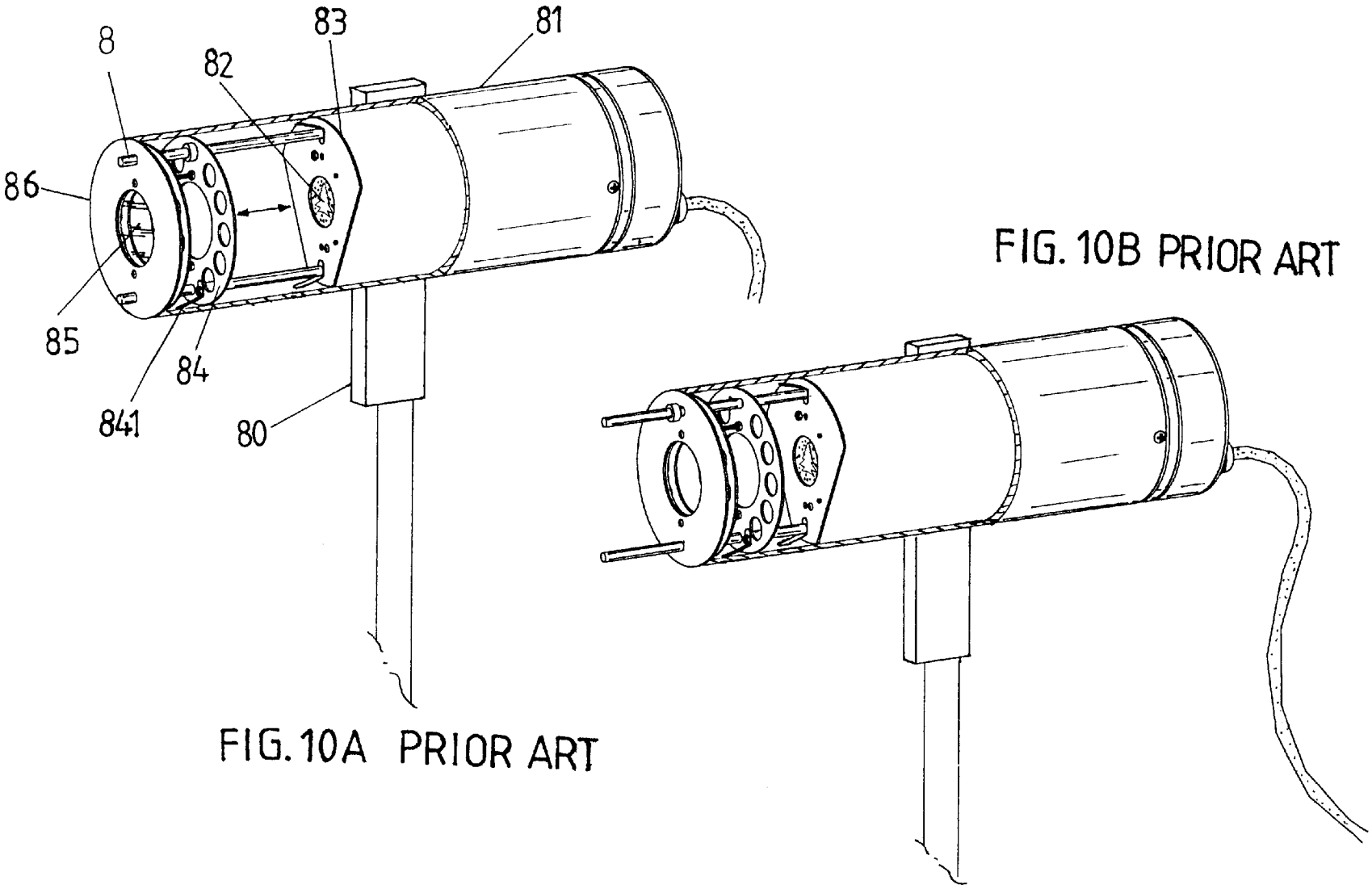
FIG. 10B PRIOR ART
FIG. 10A PRIOR ART
FIGS. 10A and 10B are partially sectioned perspective views of a conventional projecting lamp.

When the projecting lamp of the present invention is in a fully assembled state as shown in FIGS. 1A and 1B, and the electric cord 121 is plugged into a power source, such as a general wall-mount socket, for the illuminating means to emit light, the emitted light will pass through the projecting picture 7 and the lens 22, and an image 71 on the projecting picture 7 is magnified and projected on a plane, as shown at the right side of FIG. 9. At this point, the operator may adjust the horizontal position and the elevation angle of the lamp cylinder 1 according to the position of the plane onto which the image 71 on the projecting picture 7 is to be projected. Thereafter, the operator may turn the focus control bar 21 leftward or rightward to adjust the distance between the projecting picture 7 and the lens 22 until a clear projected image 71 is obtained.

Please note that the focus control bar 21 is a threaded bar. By turning the focus control bar 21, a precise fine adjustment of the distance between the picture 7 and the lens 22 is allowable. The focus control bar 21 is therefore superior to the straight rods 8 in the conventional projecting lamp.

The semicircular channel 251 provided on the rear ring member 25 provides a very easy way to change the projecting picture 7 in the projecting structure 2. The operator needs only to loosen the two screws 11 and remove the projecting structure 2 from the opening 13 of the lamp cylinder 1. Since the semicircular channel 251 is located at the most outer side of the projecting structure 2, the projecting picture 7 inserted therein can be easily extracted and replaced with another projecting picture having different design. The projecting structure 2 with a new projecting picture 7 can be then mounted into the lamp cylinder 1 via the opening 13 and the screws 11 are tightened again to resume a complete projecting lamp for use.

Since the threaded body portion 212 of the focus control bar 21 is engaged with a threaded hole on the middle ring member 24, the middle ring member 24 is not subject to easy moving on the threaded body portion 212 of the focus control bar 21 due to vibration or collision during normal operation or use of the projecting lamp. That is, the adjusted distance between the projecting picture 7 and the lens 22, or the adjusted focus of the projecting lamp, is not easily affected by general vibration or collision of the projecting lamp.

Moreover, unlike the conventional projecting structure that is frictionally fitted in the lamp cylinder through leaf springs 841 that are subjected to elastic fatigue, the projecting structure 2 is fixed in the front opening 13 of the lamp cylinder 1 by threading the screws 11 through the first threaded holes 131 on the lamp cylinder 1 into the clearance 222 between the lens holder 221 and the front ring member 23. Therefore, the projecting lamp of the present invention is structurally more durable for use.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A projecting lamp for projecting images to create visual and decorative effect, comprising:

a lamp cylinder in the form of a hollow cylinder having a front opening and an illuminating means mounted in said lamp cylinder for emitting intensive light;

a projecting structure mounted in said front opening of said lamp cylinder and including a lens holder, a projecting lens, a front ring member, a middle ring member, and a rear ring member sequentially arranged from front to rear, said lens holder and all of said ring members respectively defining central round holes of a predetermined diameter for light emitted by said illuminating means to pass therethrough, said projecting lens being fixedly sandwiched between said lens holder and said front ring member, and said middle and said rear ring members being fixedly mounted to two ends of fixing rods to form a unit; a pair of guide bars having one end connected to said front ring member and another end rearward extended through said middle and said rear ring members to limit said unit of said middle and said rear ring members to move -along a path defined by said guide bars; a focus control bar having a handle portion forward extended through said front ring member and said lens holder to project therefrom, and an externally threaded body portion rearward extended through a threaded hole on said middle ring member, said focus control bar being turnable at said handle portion to cause said unit of said middle and said rear ring members to axially move on and along said threaded body portion of said focus control bar as well as said guide bars relative to said projecting lens sandwiched between said lens holder and said front ring member, so that a distance between a projecting picture mounted on said rear ring member and said projecting lens is adjustable; and a supporting structure to a top of which said lamp cylinder being angularly adjustably connected;

whereby when said illuminating means emits light, said light passes said projecting picture on said rear ring member and said projecting lens to project and magnify an image on said projecting picture on a plane.

2. A projecting lamp as claimed in claim 1, wherein a clearance exists between said lens holder and said front ring member sandwiching said projecting lens in between them, and wherein said lamp cylinder is provided adjacent to said front opening with two diametrically opposite threaded holes via which screws being threaded into said clearance to fix said projecting structure in said front opening of said lamp cylinder.

3. A projecting lamp as claimed in claim 1, wherein said supporting structure includes a U-shaped connecting means, a base, and a supporting post extended between said U-shaped connecting means and said base; said lamp cylinder being suspended in said U-shaped connecting means by threading two first adjusting screws through threaded holes provided at two ends of said connecting means into two opposite threaded holes provided on said lamp cylinder near a middle point thereof; and said lamp cylinder being adjustable in its elevation angle by loosening said first adjusting screws and turning said lamp cylinder to a desired angular position relative to said supporting structure before said first adjusting screws are tightened again.

4. A projecting lamp as claimed in claim 3, wherein said U-shaped connecting means is provided with a central threaded hole via which a second adjusting screw is screwed into a top of said supporting post, and said lamp cylinder being rotatable in a plane by 360 degrees by loosening said second adjusting screw.

5. A projecting lamp as claimed in claim 3, wherein said base is provided at a top with a central hole into which a lower end of said supporting post is inserted, and at a lower portion with a plurality of guide grooves to which supporting feet are detachably connected for said supporting structure to stably stand.

6. A projecting lamp as claimed in claim 1, wherein said lamp cylinder is connected at an outer rear end to a transformer that has a power cord connected to an external power source to supply stable power to said illuminating means.

7. A projecting lamp as claimed in claim 1, wherein said rear ring member is provided at an outer rear side along said central round hole with a semicircular channel for said projecting picture to easily insert into and remove from said semicircular channel.

* * * * *